US006535772B1

(12) United States Patent
Miyamori et al.

(10) Patent No.: US 6,535,772 B1
(45) Date of Patent: Mar. 18, 2003

(54) WAVEFORM DATA GENERATION METHOD AND APPARATUS CAPABLE OF SWITCHING BETWEEN REAL-TIME GENERATION AND NON-REAL-TIME GENERATION

(75) Inventors: Hideo Miyamori, Hamamatsu (JP); Yuichi Sekido, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/531,741

(22) Filed: Mar. 21, 2000

(30) Foreign Application Priority Data

Mar. 24, 1999 (JP) ..... 11-080486

(51) Int. Cl.[7] ..... G10H 1/00

(52) U.S. Cl. ..... 700/90; 84/622; 84/645; 84/604; 700/17

(58) Field of Search ..... 700/90, 17, 83; 84/622, 623, 603, 604, 645; 708/312

(56) References Cited

U.S. PATENT DOCUMENTS 4,256,004 A * 3/1981 Takeuchi ..... 84/1.21
5,192,824 A * 3/1993 Shibukawa ..... 84/615
5,939,655 A * 8/1999 Sato ..... 84/625
5,959,231 A * 9/1999 Hasebe ..... 84/601
6,040,516 A * 3/2000 Masuda ..... 84/622
6,096,963 A * 8/2000 Hirano ..... 84/659
6,150,598 A * 11/2000 Suzuki et al. ..... 84/63

FOREIGN PATENT DOCUMENTS

EP 0766 226 4/1997
JP 11-265182 9/1999

* cited by examiner

*Primary Examiner*—Paul P. Gordon
(74) *Attorney, Agent, or Firm*—Morrison & Foerster LLP

(57) ABSTRACT

In generating tone waveform data for each fixed or variable section via software of a personal computer or the like, a generation start condition is changed depending on an application of the waveform data. When the waveform data is to be sounded in real time, various programs are activated in synchronism with predetermined cycles, such as tempo clock and frame cycles, in order to generate the waveform data at accurate timing. When, on the other hand, the waveform data is to be recorded in a waveform file, various programs are activated on condition that waveform data generation processing has already been completed for a preceding section. Such arrangements can eliminate limitations to processing times of the programs and thereby provide a tone waveform of high accuracy.

17 Claims, 8 Drawing Sheets

WAVEFORM DATA GENERATION METHOD AND APPARATUS CAPABLE OF SWITCHING BETWEEN REAL-TIME GENERATION AND NON-REAL-TIME GENERATION

BACKGROUND OF THE INVENTION

The present invention relates to a waveform data generation or storage method, a waveform data generation apparatus and a waveform data storage medium which are suitable for use in tone synthesis based on software of a personal computer and the like.

Systems for generating a tone waveform using a general-purpose personal computer have been proposed by the assignee of the present invention (e.g., in Japanese Patent Laid-open Publication No. HEI-10-124060). In the proposed tone waveform generation system, waveform data are sequentially generated, on a frame-by-frame basis (typically, each frame has a 10-msec time length), via a CPU of the personal computer on the basis of MIDI data. The thus-generated waveform data are then read out, on the frame-by-frame basis, via a DMA controller and then converted via a D/A converter into analog signals to be audibly reproduced or sounded.

However, in a situation where a complex algorithm is used to generate waveform data or where the CPU has an insufficient processing capability, necessary arithmetic operations to generate the waveform data can not be completed within a corresponding frame, which would make it impossible to generate a tone waveform. Such limitations are due to the fact that the conventional techniques are arranged to generate waveform data based on real-time generation principles, without specifically distinguishing between real-time generation and non-real-time generation.

SUMMARY OF THE INVENTION

It is therefore an object of the present invention to provide a waveform data generation or storage method, waveform data generation apparatus and waveform data storage medium which can generate a tone waveform in optimal condition corresponding to an available processing capability by appropriately generating waveform data while specifically distinguishing between real-time generation and non-real-time generation of the waveform data.

In order to accomplish the above-mentioned object, the present invention provides an improved method of generating waveform data on the basis of performance information, which comprises: a waveform data generation step of generating waveform data for fixed or variable sections on the basis of performance information; a step of receiving a first or second command; a step of validating performance information in real time, when the first command is received; a step of, when the first command is received, issuing an instruction to the waveform data generation step for performing real-time generation of waveform data for each of the sections on the basis of the performance information validated in real time, in accordance with a generation start condition that predetermined timing has arrived; a step of, when the first command is received, reproducing the waveform data for each of the sections generated in real time by the waveform data generation step in response to the instruction; a step of, when the second command is received, issuing an instruction for performing non-real-time generation of waveform data for each of the sections, in accordance with a generation start condition that processing by the waveform data generation step has already been completed for a preceding section; a step of, when the second command is received, validating, in non-real time, performance information corresponding to each of the sections for which the non-real-time generation of waveform data is instructed; and a step of, when the second command is received, storing, into memory, waveform data generated by the waveform data generation step on the basis of the performance information validated in non-real time.

When the waveform data is to be reproduced in real time on the basis of the performance information, for example, a reproduction instruction is given as the first command. In response to the reproduction instruction, the performance information is validated (i.e., made effective) in real time. Namely, the performance information is generated in accordance with the real time of a reproductive performance of a desired music piece. In this case, based on a generation start condition that predetermined timing has arrived, an instruction is given to the waveform data generation step for generating waveform data of each of the sections on the basis of the performance information validated in real time. As known in the art of the software tone generators, waveform data for a single time section may be generated collectively, or waveform data for each one of several sub-time sections divided from such a time section may be generated collectively. The thus-generated waveform data is then buffered as appropriate and reproduced at a predetermined reproduction sampling frequency. In this way, the waveform data generated on the basis of the performance information validated in real time can be reproduced in real time.

When, on the other hand, the waveform data generated on the basis of the performance information is to be merely stored into memory without being reproduced in real time, for example, a storage instruction is given as the second command. In response to this storage instruction, the performance information is validated or made effective in non-real time. Namely, the performance information is generated, for example, quickly or sometimes intermittently without following the real time progression of the reproductive performance of the desired music piece, in accordance with availability or processing conveniences of a processor without being influenced by time-related limitations. In this case, a waveform generation instruction is issued to the waveform data generation step, in accordance with a generation start condition or criteria that processing by the waveform data generation step has already been completed, i.e., generation of waveform data to be generated by then has already been completed, so as to instruct the waveform data generation step to perform non-real time generation of waveform data for a next section. The waveform data generated for each of the sections in non-real time on the basis of the performance information validated or made effective in non-real time is then stored into memory. By virtue of the nature of the non-real time processing, the waveform generation can be performed without being adversely influenced by time-related limitations. Therefore, all the necessary waveform generation processing can be carried out without any significant time-related limitations (for example, where a plurality of waveform generation processing modules are available, all of them can be utilized), which permits high-accuracy and high-quality waveform data generation.

According to another aspect of the present invention, there is provided a method of generating waveform data for each of fixed or variable sections on the basis of performance information, which comprises: a plurality of waveform data generation steps of generating waveform data using respective ones of different generation schemes based on performance information; a step of receiving a first or second command; a step of selecting one of the plurality of waveform data generation steps, depending on which one of the first and second commands is received; a step of, when the first command is received, instructing the selected waveform data generation step to generate waveform data for each of the sections, in accordance with a generation start condition that predetermined timing has arrived; and a step of, when the second command is received, instructing the selected waveform data generation step to generate waveform data for each of the sections, in accordance with a generation start condition that processing by the waveform data generation step has already been completed for a preceding section.

Because the waveform data generation responsive to the second command is performed in accordance with the generation start condition or criteria that the waveform data generation has already been completed for a preceding section, it can be prevented from being influenced by the time-related limitations, just as in the afore-mentioned method. Therefore, such a waveform data generation step, for example, more complicated, i.e., more time-consuming, can be selected in response to the second command. Because of the arrangement that one of the waveform data generation steps, using an optimal generation scheme, can be selectively performed depending on a distinction between various waveform-data-generation-start conditions, the present invention constantly achieves efficient waveform data generation processing.

According to still another aspect of the present invention, there is provided a method of generating waveform data on the basis of performance information and storing the generated waveform data, which comprises: a step of generating waveform data in real time on the basis of performance information and simultaneously reproducing the generated waveform data; a step of stopping reproduction of the waveform data halfway through the reproduction and specifying a stop position in the performance information; a step of generating, in non-real time, the waveform data corresponding to the performance information for a portion following the stop position; and a step of storing, into memory, the waveform date reproduced in non-real time.

In this method, the waveform generation can be changed from a real-time mode to a non-real time mode during the course of the waveform reproduction. Thus, when the reproductive performance being executed in real time has progressed to a desired performance position, it can be switched to the non-real time waveform generation mode as desired, so that waveform data based on the performance information to follow that performance position can be generated with increased efficiency and accuracy, which thereby permits efficient creation of a waveform data file to be stored in memory.

According to still another aspect of the present invention, there is provided a method of generating waveform data on the basis of performance information and storing the generated waveform data, which comprises: a step of generating waveform data in non-real time on the basis of the performance information and simultaneously storing the generated waveform data into memory; a step of displaying information indicative of a position in the waveform data corresponding to the performance information where non-real time generation is being performed; a step of receiving a stop instruction halfway through the non-real time generation; and a step of stopping the non-real time generation and storage of the waveform data, when the stop instruction is received.

In this case, the stop instruction is issued when waveform data is being generated in non-real time efficiently with enhanced accuracy and being stored into memory, so that the non-real-time generation and storage can be stopped in response to the stop instruction, oppositely to the above-mentioned case. Thus, the waveform data generated up to a desired performance position can be stored in memory, which thereby permits efficient creation of a waveform data file to be stored in memory.

The present invention may be constructed and implemented not only as a method invention as mentioned above but also as an apparatus invention. The present invention may also be implemented as a program for execution by a computer, microprocessor, DSP or the like, as well as a machine-readable storage medium storing such a program. Further, the hardware implementing the present invention may partly comprise a functionally-fixed hardware device including a combination of logic circuitry and gate array or an integrated circuit, without being necessarily limited to a programmable facility such as a computer or microprocessor. Further, the tone synthesis system embodying the present invention is not limited to a personal computer so programmed as to be capable of music performance and may be in the form of a dedicated electronic musical instrument such as a keyboard instrument, karaoke apparatus, game apparatus, cellular phone or any other type of multimedia equipment.

BRIEF DESCRIPTION OF THE DRAWINGS

For better understanding of the object and other features of the present invention, its preferred embodiments will be described in greater detail hereinbelow with reference to the accompanying drawings, in which.

DETAILED DESCRIPTION OF THE PREFERRED EMBODIMENTS

1. Hardware Setup of Preferred Embodiment

Figure 1:
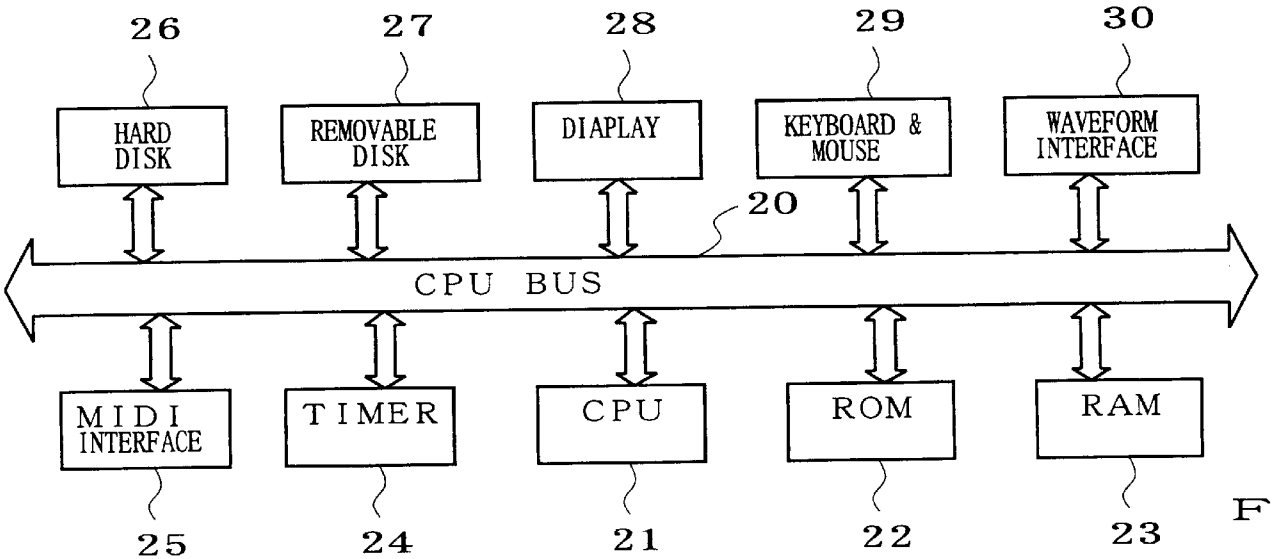
FIG. 1 is a block diagram showing an exemplary organization of a tone synthesis system in accordance with a preferred embodiment of the present invention.

First, a description will be made about an exemplary hardware setup of a tone synthesis system in accordance with a preferred embodiment of the present invention, with reference to FIG. 1. As shown, the tone synthesis system includes a CPU 21 that controls various components of the system via a CPU bus 20, a ROM 22 having stored therein an initial program loader and the like, and a RAM 23 for storing various programs and data for access by the CPU 21. Reference numeral 24 represents a timer that issues interrupt signals to the CPU 21 at predetermined time intervals.

The tone synthesis system also includes a MIDI interface 25 for communicating MIDI signals with external MIDI equipment (not shown). In a hard disk device 26, there are prestored an operating system, various drivers, various application programs, performance information and the like. Removable disk device 27 includes a CD-ROM drive, MO-drive, etc., where are stored information and programs similar to those in the hard disk device 26. Display 28 is in the form of a CRT or liquid crystal display (LCD), which visually presents various information to a user. The tone synthesis system also includes an input unit such as a keyboard and a mouse, which supplies various information to the CPU 21 in response to operation by the user. Further, reference numeral 30 represents a waveform interface via which an analog waveform is input or output to or from the tone synthesis system.

Figure 2:
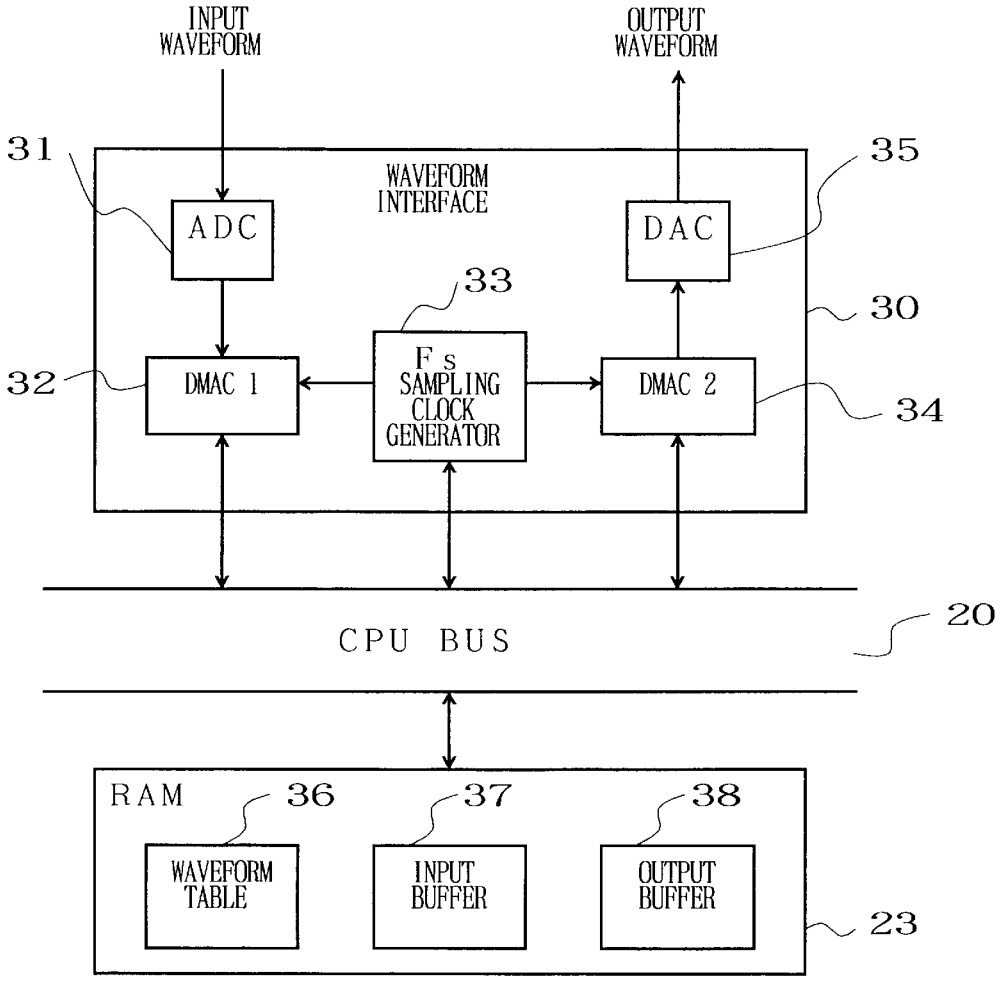
FIG. 2 is a block diagram showing structural details of a waveform interface and a RAM shown in FIG. 1.

The following paragraphs describe in more detail the waveform interface 30 and RAM 23, with reference to FIG. 2. As shown, the waveform interface 30 includes an A/D converter that converts an input analog signal into a digital signal. Sampling clock generator 33 generates clock pulse signals at a predetermined sampling frequency. Further in the waveform interface 30, a first DMA controller 32 samples output signals from the A/D converter 31 and transfers the sampled results to a designated area of the RAM 23 through direct memory access in synchronism with the pulse clock signals. Also included in the waveform interface 30 is a second DMA controller 34 that, in synchronism with the clock pulse signals output from the sampling clock generator 33, reads out digital waveform data from the RAM 23 through the direct memory access. Further, a D/A converter 35 converts each of the read-out digital waveform data into an analog signal.

The RAM 23 includes a waveform table area 36 for storing various prototypes of waveform data, and an input buffer area 37 into which waveform data are written via the first DMA controller 32. The RAM 23 also includes an output buffer area 38 where are stored waveform data to be read out by the second DMA controller 34. The output buffer area 38 is in the form of a ring buffer whose readout address is determined by a circulatively-incremented read pointer.

2. Behavior of Preferred Embodiment

Figure 3:
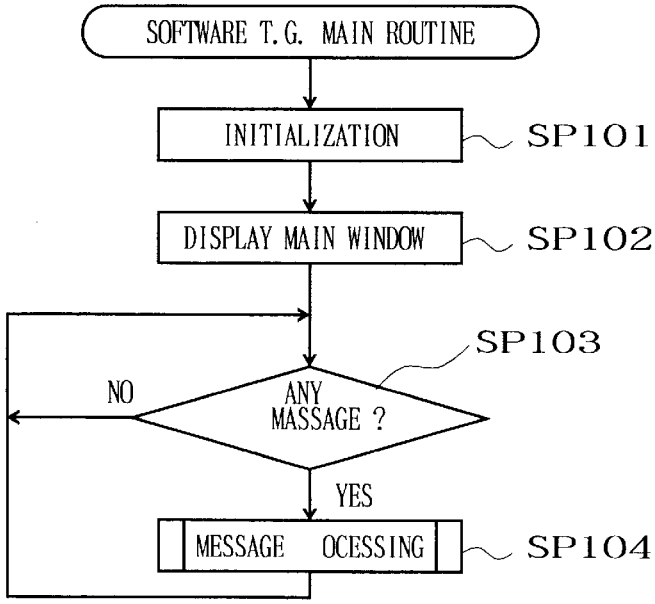
FIG. 3 is a flow chart of a main routine performed in the embodiment of FIG. 1.

2.1. Main Routine:

Now, a description will be made about operation of the tone synthesis system in accordance with the preferred embodiment of the present invention. The tone synthesis system, which is a type of application program for execution of a general-purpose personal computer, operates under the control of the operating system. Main routine of the tone synthesis system shown in FIG. 3 is started up or activated in response to a predetermined operation performed in a shell program of the operating system. At step SP101, a predetermined initialization process is carried out. At next step SP102, a main window 50 as shown in FIG. 4 is visually presented on the display 28.

Figure 4:
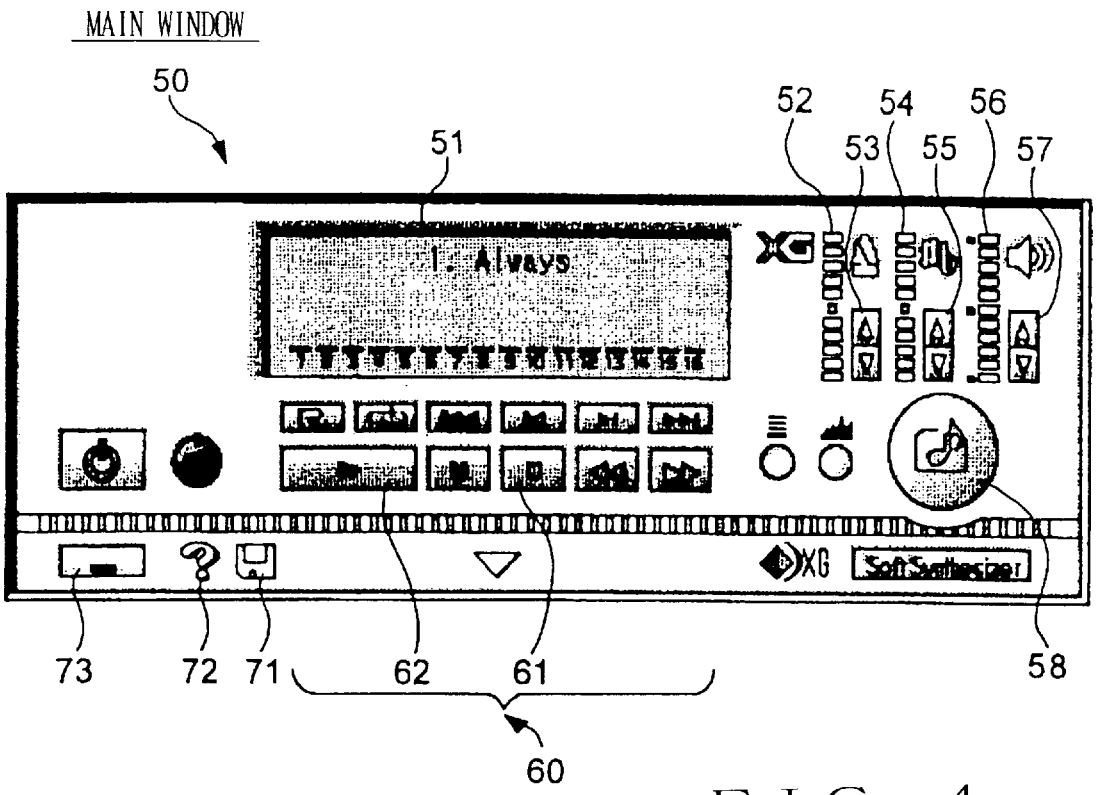
FIG. 4 is a diagram showing a main window presented on a display in the embodiment.

In FIG. 4, reference numeral 51 represents an indicator section where are shown a name of a music piece to be reproduced etc. Tempo indicator 52 in the main window 50 indicates a tempo at which waveform data are to be reproduced. Reference numeral 53 represents a button for setting such a reproduction tempo. Key indicator 54 indicates a tone pitch of each key depressed during reproduction of waveform data, and a button 55 is a button for setting these key pitches. Reference numeral 56 represents a tone volume indicator indicating a tone volume with which the waveform data are to be reproduced, and this volume is set via a tone volume setting button 57.

Further, a music piece selecting button 58 is provided for designating a file storing MIDI data (performance information) to be reproduced or directory containing the file. Further, in the main window 50, there are provided reproduction operator buttons 60 which are usable by the user to start, end, pause, fast-forward, fast-wind, auto-reverse, skip, etc. the reproduction of the waveform data. In particular, the reproduction of the waveform data can be started, stopped and ended by the user clicking on a reproduction start button 62 and reproduction stop button 61 via the mouse. Reference numeral 71 is a button for recording waveform data; the waveform data recording can be started by the user using the mouse to click on this recording button 71 after designation of a desired waveform file. Help button 72 can be clicked on, via the mouse, to cause contents of a predetermined help file to be visually displayed. End button 73 is provided to give an instruction for ending the tone synthesis system of the described embodiment.

Referring back to FIG. 3, at step SP103, a determination is made as to whether any message has been received from the operating system. With a negative (i.e., NO) determination, this step SP103 is repeated until receipt of a message from the operating system is detected. Once a receipt of a message from the operating system is detected, the main routine moves on to step SP104, where processing is carried out in accordance with a content of the received message. After step SP104, the operations of steps SP103 and SP104 are repeated.

2.2. Timer Process in the Operating System:

Application programs, such as the tone synthesis system of the described embodiment, can make timer message settings to the operating system. Once such timer message settings are made, the operating system transmits timer messages at predetermined intervals. In this embodiment, a timer message is transmitted from the operating system to the tone synthesis system every two cycles: "tempo clock cycle"; and "frame cycle".

Here, the "tempo clock" is a unit of timing to generate a MIDI event, which represents a time period equal to 1/16 of a quarter note. Therefore, the tempo clock cycle is changed each time a tempo is set via the tempo setting button 53 etc. Further, in the described embodiment, waveform data are synthesized for each subdivided time period. The "frame" represents a cyclic period that functions as a unit time to synthesize waveform data and is set, for example, to "10 msec". Here, the timer message process is given a low priority in the operating system, and thus it is possible that the timer messages are sometimes delayed or skipped.

2.3. Event Process Responsive to Music Piece Selecting Button 58:

Once the music piece selecting button 58 is clicked on via the mouse, the operating system transmits, to the tone synthesis system, a message to that effect. Then, upon detection of such a message at step SP103, a sub-window (not shown) prompting the user to designate a name of a music piece file (MIDI file) is presented on the window. As the user designates a desired music piece file name and closes the sub-window, the designated music piece file name is stored into memory and the processing flow returns to the main routine after the closing of the sub-window. Note that the "music piece file" in the described embodiment is a file comprising automatic performance data (MIDI data) of a music piece, and the "waveform file" is a file comprising waveform data (time-axial waveform sample data) covering all or some of performance tones of a music piece.

Figure 6:
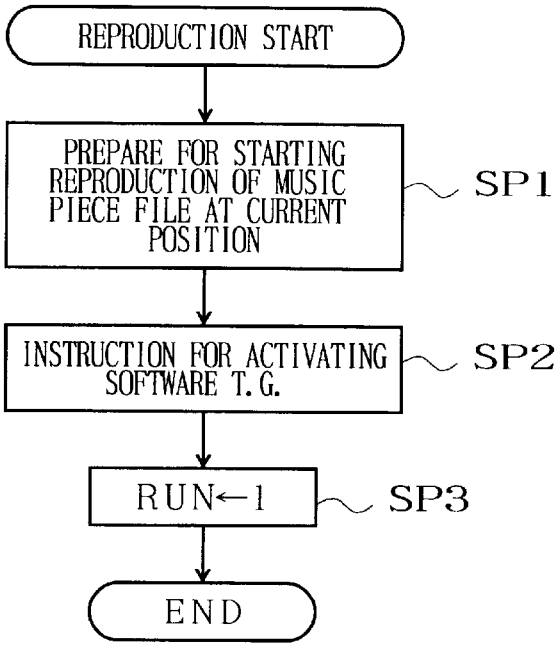
FIG. 6 is a flow chart of a reproduction start subroutine performed in the embodiment.

2.4. Event Process Responsive to Reproduction Start Button 62:

Once the reproduction start button 62 is clicked on via the mouse after designation of a music piece file name, the operating system informs the tone synthesis system to that effect, so that the tone synthesis system starts up or activates a reproduction start routine as flowcharted in FIG. 6. At step SP1 of the reproduction start routine, preparations are made to start reproducing the designated music piece at a current position of the music piece (i.e., in an initial state, at the very beginning of the music piece, or during a temporary halt, at a position where an operation to effect the halt took place). Also, the operating system is requested to transmit the timer message for each frame cycle. Then, at next step SP2, a software tone generator is activated which will be later described in detail. At following step SP3, a RUN flag is set to a value "1" and the processing flow returns to the main routine.

Figure 8:
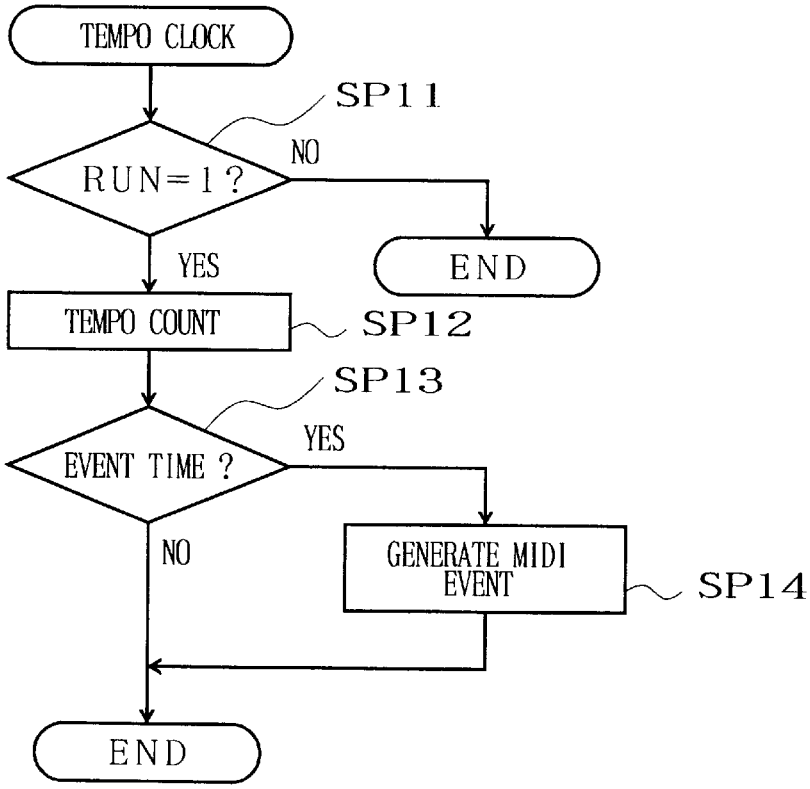
FIG. 8 is a flow chart of a tempo clock event process subroutine performed in the embodiment.

2.5. Tempo Clock Event Process:

When a tempo clock message is received from the operating system during the main routine, a tempo clock event process routine of FIG. 8 is started at step SP104. At step SP11 of FIG. 8, a determination is made as to whether the RUN flag is at the value "1" or not. With a negative (NO) determination, the tempo clock event process routine is terminated immediately. If, on the other hand, the RUN flag is at "1" as determined at step SP11, i.e., if the above-mentioned reproduction start routine of FIG. 6 has been performed, then a positive (YES) determination is made, so that the processing flow proceeds to step SP12.

At step SP12 of FIG. 8, a predetermined tempo counter, which has been initialized to a value "0" in the initialization process, is incremented by "1". Thus, the tempo counter gives a variable counting the number of tempo clock pulses after the RUN flag has been set to "1". At next step SP13, a reference is made to the music piece file previously prepared at step SP1, and it is determined, on the basis of the above-mentioned tempo counter, whether or not a predetermined time has arrived to reproduce any event.

If answered in the affirmative at step SP13, the routine goes to step SP14, where a MIDI event corresponding to the time is caused to occur. When some note-on event is to occur, a particular tone generating channel is allocated for the note-on event. Namely, an area is allocated or reserved in the RAM 23 to store various tone generation parameters for the note-on event, and such tone generation parameters are set depending on the type of the tone generator used. If the MIDI event is a note-off event, a predetermined tone deadening (silencing) process is performed as necessary, and then a corresponding tone generating channel is released from the allocated state.

Figure 10:
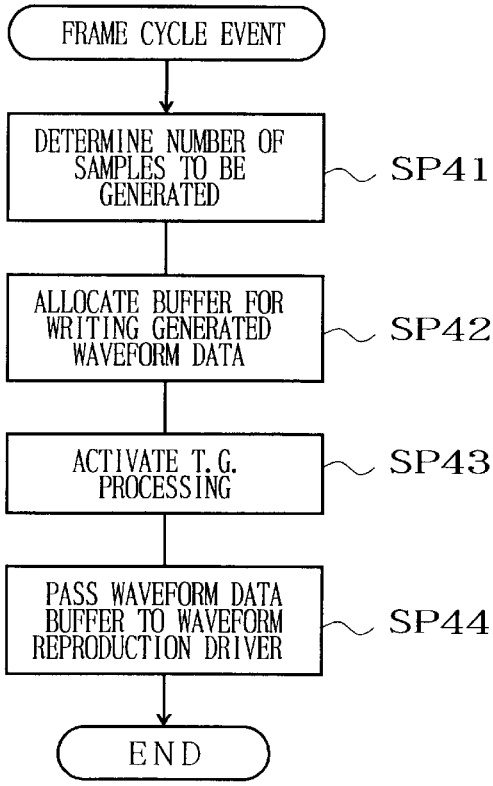
FIG. 10 is a flow chart of a frame cycle event process subroutine performed in the embodiment.

2.6. Frame Cycle Event Process:

When a frame cycle message is received from the operating system during the main routine, a frame cycle event process routine of FIG. 10 is started at step SP104. At step SP41 of FIG. 10, a specific number of samples to be generated is determined in accordance with the number of frames to be formed this time. Only one frame has to be formed in normal cases; however, in case a frame cycle message is left out, a particular number of frames corresponding to the skipped frame cycle message is additionally added to the number. Namely, although, in principle, one frame message is issued every predetermined frame cycle, the frame message is sometimes left out when the CPU 21 can not spare time for waveform generation processing because the CPU 21 is performing other processing of greater importance or higher priority.

At step SP42 of FIG. 10, a buffer area is allocated for writing therein waveform data for the number of frames to be formed. Then, the frame cycle event process routine goes to step SP43, in order to activate a tone generator processing routine as flowcharted in FIG. 11. As will be later detailed, the waveform data for the number of frames are written into the allocated buffer area through the tone generator processing routine. At next step SP44, the waveform data are transferred to the output buffer area 38, in order to pass the generated waveform data to the waveform interface 30. Upon completion of the above-mentioned operations, the processing flow returns to the main routine. The waveform data thus transferred to the output buffer area 38 are read out, one sample per sampling cycle, by the second DMA controller 34 and then output after being converted into analog representation by the D/A converter 35, through the above-described operations.

As noted earlier, the output buffer area 38 is in the form of a ring buffer whose readout address is a circulatively-incremented read pointer. Address to store each currently-generated waveform data is designated by a write pointer that is circulatively incremented similarly to the read pointer. The write pointer is always preceding the read pointer by an interval of several frames, so that the write pointer and read pointer would point to two addresses circulating within the output buffer area 38 while keeping the interval therebetween substantially constant.

If the frame cycle message is left out once or a plurality of times in succession, the interval between the write pointer and the read pointer point would be shortened temporarily by an amount corresponding to the number of the frame cycle messages left out; however, when step SP41 is invoked next time, the numbers of the frames to be formed and the samples to be generated are determined such that the number of the frame cycle messages left out can be recovered properly. In other words, the interval between the write pointer and the read pointer point can serve as a time margin to properly deal with the omission of the frame cycle messages.

2.7. Tone Generator Processing:

According to the described embodiment, the waveform data generation is performed via a software module operated by the CPU 21. The waveform-data generating software module generally comprises tone generator modules and effect modules. Each of the tone generator modules implements a predetermined one of various tone generation schemes, such as FM, PCM and physical model tone generators, to thereby generate waveform data. Each of the effect modules imparts a selected effect, such as reverberation or chorus, to the generated waveform data. More specifically, a plurality of the tone generator modules are provided in corresponding relation to different types of tone generation schemes, such as the above-mentioned FM, PCM and physical model tone generators, and a plurality of the effect modules are provided in corresponding relation to different effects.

Figure 14:
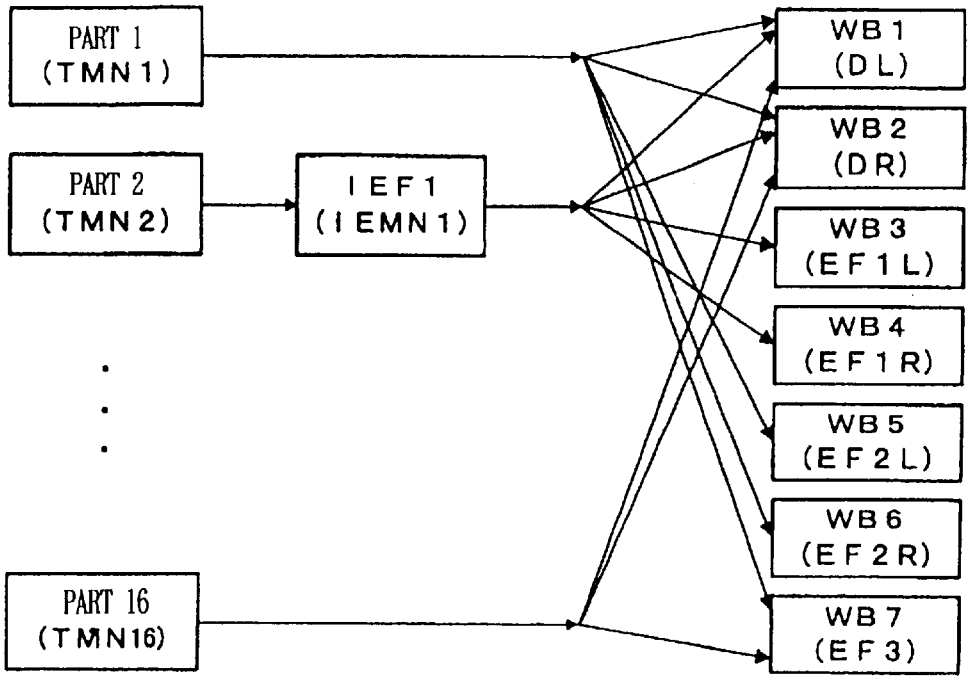
FIG. 14 is a diagram explanatory of operation of tone generator modules employed in the present invention.
Figure 15:
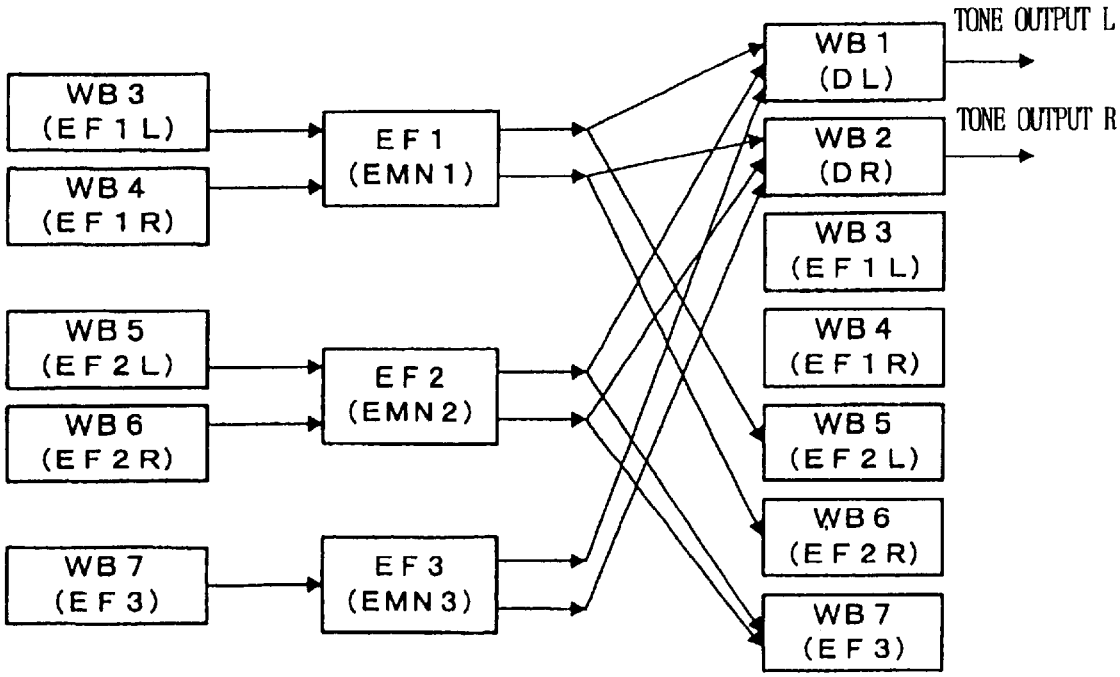
FIG. 15 is a diagram explanatory of operation of effect generator modules employed in the present invention.

The RAM 23 includes buffers for use in exchanging the waveform data between the tone generator modules and the effect modules. In FIGS. 14 and 15, there are shown waveform data flows between the modules and the buffers. The waveform data corresponding to "part 1" shown in FIG. 4 is multiplied by send levels of five channels, and the multiplied results are written into the buffers WB1, WB2 and WB5–WB7. The waveform data corresponding to "part 2" shown in FIG. 14 is imparted with an insertion effect IEF1, then multiplied by send levels of four channels, and the multiplied results are accumulated into the buffers WB1–WB4; the newly-multiplied results are added to the contents of the buffers WB1–WB4. In this way, the waveform data corresponding to part 1–part 16 are imparted with the insertion effect IEF1 as necessary, and written into the buffers W1–W7 at various send levels.

Next, in FIG. 15, a first effect EF1 is imparted, via any one of the effect modules, to the stored contents of the buffers WB3 and WB4, then the thus-effect-imparted results are multiplied by send levels of four channels, and then the multiplied results are accumulated into the stored contents of the buffers WB1, WB2, WB5 and WB6. After that, a second effect EF2 is imparted to the stored contents of the buffers WB5 and WB6, then the thus-effect-imparted results are multiplied by send levels of four channels, and then the multiplied results are accumulated into the stored contents of the buffers WB1, WB2 and WB7. Subsequently, a third effect EF3 is imparted to the stored contents of the buffer WB7, then the thus-effect-imparted results are multiplied by send levels of two channels, and then the multiplied results are accumulated into the stored contents of the buffers WB1 and WB2.

The stored contents of the buffers WB1 and WB2 are delivered, as final results of the tone generation processing, to a source routine requesting them. Namely, in the above-described frame cycle event process routine of FIG. 10, the stored contents of the buffers WB1 and WB2 are transferred to the output buffer area 38 in accordance with the write pointer. Thus, in the described embodiment, tone waveforms can be generated in various different ways by just predetermining the tone generator modules, effect modules, input/output buffers and send levels.

Figure 11:
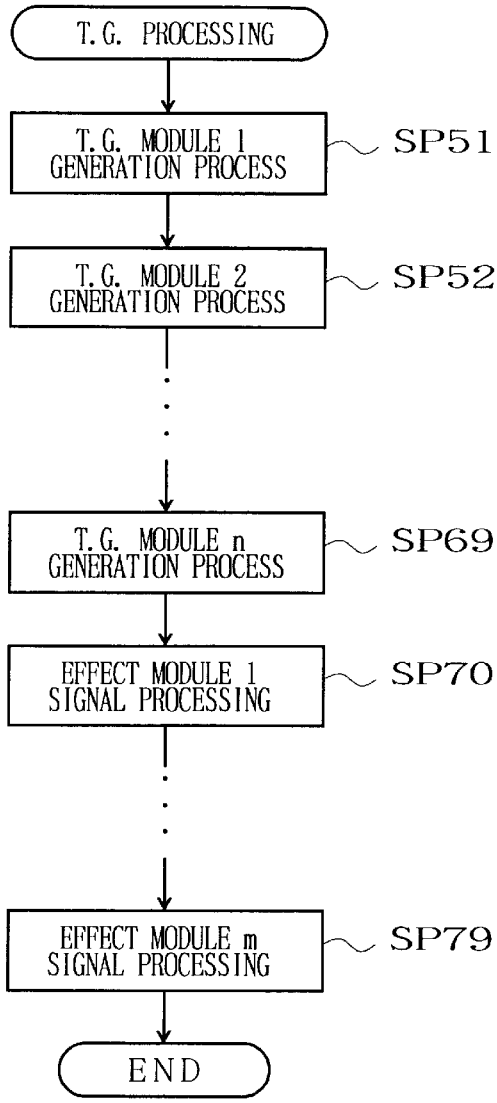
FIG. 11 is a flow chart of a tone generator processing subroutine performed in the embodiment.

As long as the input/output buffers and send levels are predetermined, a desired mixing result can be provided through sequential processing by the tone generator modules and effect modules, as flowcharted in FIG. 11. At steps SP51–SP69 of FIG. 11, the tone generator modules and insertion effect modules are executed in sequence, and the resultant waveform data are stored into the buffers WB1–EB7. Then, at steps SP70–SP79, the effect modules are executed in sequence, and the final waveform data are stored into the buffers WB1 and WB2. Method of generating waveforms in the above-mentioned manner is disclosed in Japanese Patent Laid-open Publication No. HEI-10-124060 and Japanese Patent Application No. HEI-10-133761.

In the tone generator processing of FIG. 11, n tone generator modules and m effect modules are executed in sequence; however, the number and contents of the modules executed in this tone generator processing may be modified as desired in accordance with manipulation of predetermined operators by the user, control code, etc. Any of various types of tone generator modules, such as physical model tone generator module, PCM tone generator, FM tone generator and tone synthesis tone generator, can be selected for use as the tone generators in the described embodiment. Further, tone generators of a same type, employing different algorithms and sampling frequencies, can be selected for use as the tone generators in the described embodiment. On the other hand, as the effect modules, any of reverberation, chorus, distortion, compressor modules can be selected for use in the embodiment.

Figure 7:
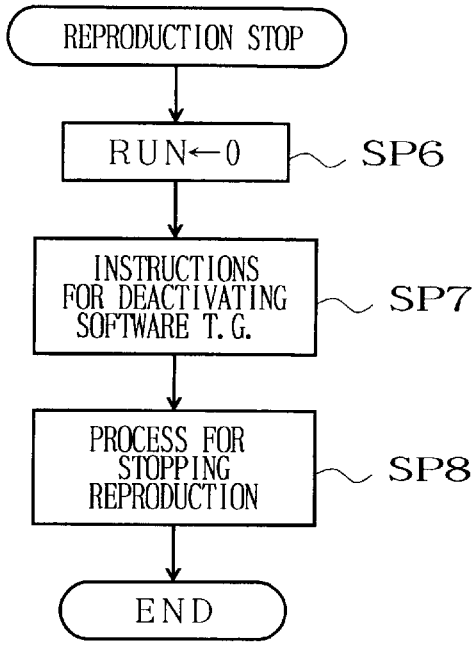
FIG. 7 is a flow chart of a reproduction stop subroutine performed in the embodiment.

2.8. Event Process Responsive to Reproduction Stop Button 61:

Once the reproduction stop button 61 is clicked on via the mouse, the operating system informs the tone synthesis system to that effect, so that the tone synthesis system starts up a reproduction stop routine as flowcharted in FIG. 7. At step SP6 of the reproduction stop routine, the RUN flag is set to a value "0", so that no substantive processing takes place even when the tempo clock process routine is invoked.

At next step SP7, an instruction is issued for deactivating the software tone generator. Namely, in substantially the same way as when a note-off event has occurred in each of the tone generating channels, a predetermined tone deadening (silencing) process is performed as necessary, and then every corresponding tone generating channel is released. After that, the routine moves on to step SP8 in order to carry out a process for stopping reproduction of the music piece file, and then returns to the main routine.

Figure 9:
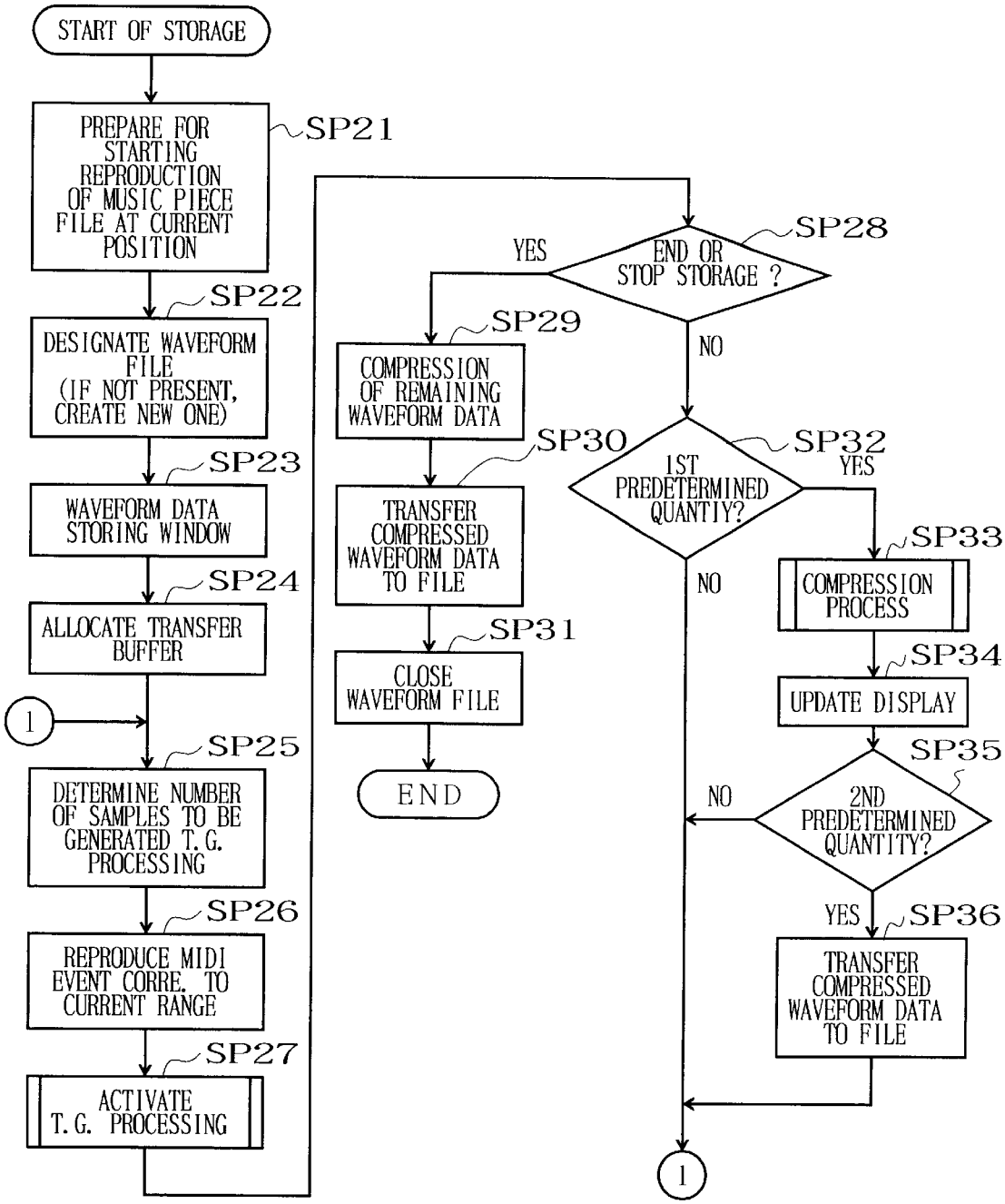
FIG. 9 is a flow chart of a waveform data storage subroutine performed in the embodiment.

2.9. Event Process Responsive to Waveform Data Recording Button 71:

Once the waveform data recording button 71 is clicked on via the mouse, the operating system informs the tone synthesis system to that effect, so that the tone synthesis system starts up a waveform data storage routine as flowcharted in FIG. 9. At step SP21 of the waveform data storage routine, preparations are made for starting reproduction at a current position of a currently-selected music piece file.

Here, the terms "current position" refer to the beginning of the currently-selected music piece file when the reproduction of the music piece file has not yet been started, but they refer to a currently reproduced position when the reproduction of the music piece file is under way. Stated differently, in the described embodiment, the waveform data of a desired music piece file can be recorded immediately after the music piece file is designated, or recording or storage of the waveform data of the desired music piece file can be started at any desired performance position when a performance of the music piece file is being reproductive sounded in real time. In the former case, the waveform data of the performance tones can be recorded starting with the head of the music piece, while in the latter case, the waveform data of the performance tones can be recorded starting with any desired halfway (on-the-way) position of the music piece. Because no tone generation processing is performed during the course of the recording, the operating system is requested to not send the "tempo clock cycle" and "frame cycle" timer messages.

At next step SP22 of FIG. 9, a window (not shown) prompting the user to enter a name of a waveform file is presented on the display 28. Once the user designates a desired waveform file name, the designated waveform file is opened. If the designated waveform file is not prestored, then it will be newly created and opened.

Figure 5:
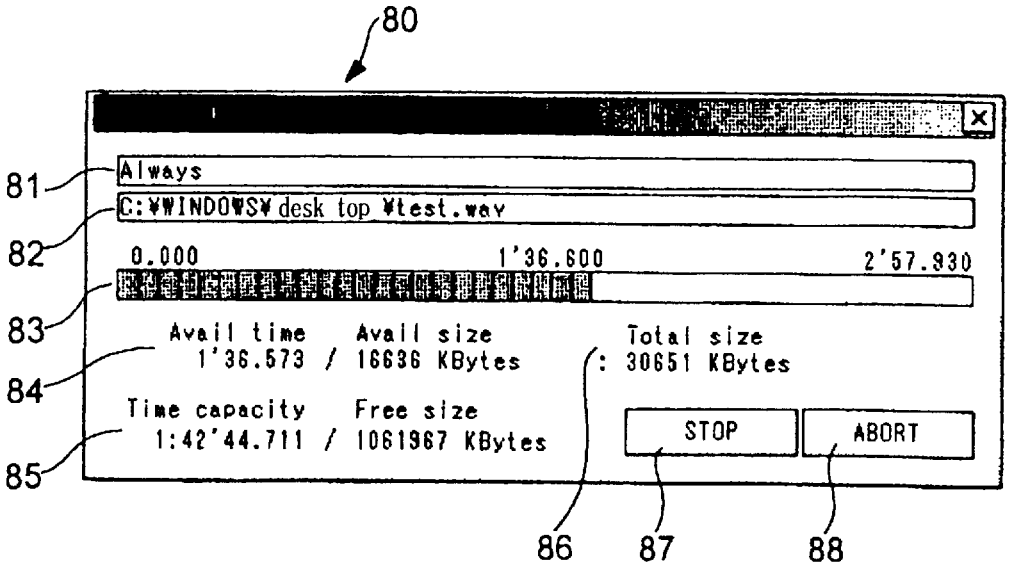
FIG. 5 is diagram showing a waveform data storage window presented on the display in the embodiment.

Further, as an option in designating a desired waveform file name, a radio button is also displayed for the user to give an instruction as to whether or not the waveform data of the waveform file should be compressed. Upon clicking on this radio button via the mouse, the waveform data are recorded into the waveform file while being compressed. After following step SP23, a waveform data storing window 80 is shown on the display 28 as illustrated in FIG. 5. In FIG. 5, reference numeral 81 represents a music piece name display box where the music piece name having been shown in the indicator section 51 is displayed.

Further, reference numeral 82 represents a file name display box where the waveform file name having been designated is displayed. Reference numeral 83 represents a progress graph box where are displayed, in numeric values, a time corresponding to the reproduction start position of the music piece file (0'00.000), a time corresponding to the end position of the music piece file (2'57.930) and a time indicative of a progress in waveform data generation (1'36.600). The progress in the waveform data generation is also displayed in a percentage graph where a time period from the reproduction start position to the end position is used as 100%. Reference numeral 84 represents a recording progress display area where are displayed a time length of the waveform data having been so far recorded into the waveform file and a size of the waveform file corresponding thereto.

Further, in FIG. 5, reference numeral 85 represents a disk limit display area where are displayed a free or currently-available storage space of a drive (e.g., the hard disk 26 or the removable disk 27) to which the waveform file belongs and a time length of the waveform data recordable into the drive having such a currently-available storage space. Total size display area 86 shows a total size of the waveform data having been recorded by reproducing the entire music piece file from the reproduction start position to the end position. Stop button 87 is provided for operation by the user to stop the waveform data recording halfway through and retain the waveform file containing the waveform data having been generated so far. Further, reference numeral 88 represents an abort button provided for operation by the user to abort the waveform data recording and discard the recorded results.

Referring back to FIG. 9, at step SP24, a transfer buffer area is allocated in the RAM 23 for temporarily storing the waveform data. Then, a total number of samples of waveform data to be generated collectively through the tone generator processing routine (FIG. 11) is determined at next step SP25. In the real-time tone generation mode, the number of samples of waveform data to be generated collectively is determined in accordance with the number of frame cycle messages left out, as described above in relation to step SP41; however, in this waveform data recording mode, such a total number of samples of waveform data as to achieve a highest efficiency may be variably selected in light of the availability of the CPU 21 (i.e., in light of trade-off between the waveform storage process and other processing that is being performed by the CPU 21 concurrently with the waveform storage process), because, in this case, there are no time-related limitations as imposed by real-time reproduction.

After that, the routine moves on to step SP26 in order to search the music piece file for any MIDI event corresponding to a range (performance time range) of waveform data to be generated this time. Such a MIDI event is then generated if it exists. Namely, in the same manner as described earlier in relation to step SP14, when a note-on event is to occur, a particular tone generating channel is allocated for the note-on event, but when a note-off event is to occur, a predetermined tone deadening (silencing) process is performed, as necessary, where a tone assigned to a corresponding tone generating channel is controlled to start being attenuated, and then the corresponding tone generating channel is released when waveform forming calculations have been performed, through several cycles of the tone generator processing, for a time period to cause the tone to be attenuated sufficiently. Note that because the waveform data generation is performed in non-real time during the waveform data recording, time between individual MIDI events is controlled to advance in non-real time. For this purpose, a performance time of the waveform data having been generated may be managed by being counted via a non-real-time performance time counter. The count of the non-real-time performance time counter can be used as time information indicative of a position where the waveform data is being currently written.

At next step SP27 of FIG. 9, the tone generator processing routine (FIG. 11) is invoked, so that the number of samples of waveform data, having been determined earlier at step SP25, are generated and stored into the buffers WB1 and WB2. At following step SP28, a determination is made as to whether or not recording of all the contents of the music piece file has been completed or whether the stop button 87 (or abort button 88) has been clicked on via the mouse. If the recording of all the contents of the music piece file has not been completed and the stop button 87 (or abort button 88) has not been clicked on, then a negative (NO) determination is made at step SP28, and the processing flow moves on to step SP32.

Figure 16:
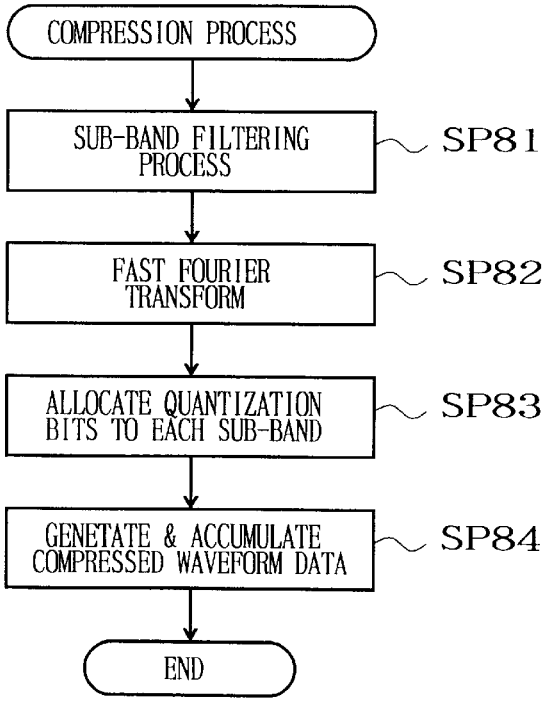
FIG. 16 is a flow chart showing a compression process subroutine performed in the embodiment of the present invention

At step SP32, it is determined whether the waveform data accumulated in the RAM 23 have reached a first predetermined quantity. With a negative or NO determination, the routine reverts to step SP25 in order to determine the number of samples of waveform data to be next generated collectively, and then goes to steps SP26 and SP27 to generate the thus-determined number of samples of waveform data. Thus, the generated waveform data are accumulated into the RAM 23. Once an affirmative (YES) is made at step SP32, the routine proceeds to step SP33. At step SP33, a subroutine as flowcharted in FIG. 16 is invoked, where the waveform data are subjected to a compression process and the thus-compressed waveform data are accumulated into the RAM 23 as will be later described more fully. At following step SP34, the information displayed in the progress graph box 83, recording progress display area 84 and disk limit display area 85 is updated in accordance with the quantity of the compressed waveform data. This way, each time the waveform data accumulated in the RAM 23 have reached the first predetermined quantity, they are subjected to the compression process. The first predetermined quantity in this embodiment may be determined optionally as a data unit on which the waveform data. compression process is to be performed.

Then, at next step SP35, it is determined whether the compressed waveform data accumulated in the RAM 23 have reached a second predetermined quantity. With an affirmative answer, the routine goes to step SP36, where the compressed waveform data are transferred to the waveform file. Note that unless the waveform data stored in the transfer buffer area has not reached the above-mentioned first predetermined quantity, steps SP32–SP36 are skipped. After that, the routine reverts to step SP25 in order to determine the number of samples of waveform data to be next generated collectively, so that the operations after step SP25 are repeated. This way, each time the compressed waveform data accumulated in the RAM 23 have reached the second predetermined quantity, they are transferred to the waveform file. Such a second predetermined quantity corresponds to a data unit, such as a cluster, to be read/written on a disk or other storage medium.

If the compressed waveform data accumulated in the RAM 23 have not reached the second predetermined quantity as determined at step SP35, then the operations at and after step SP25 are repeated without the compressed waveform data being transferred to the waveform file. If the recording of all the contents of the music piece file has been completed or if the stop button 87 (or abort button 88) has been clicked on via the mouse, then an affirmative determination is made at step SP28, and the processing flow moves on to step SP29.

At step SP29, a compression process is performed on the waveform data remaining in the transfer buffer area, to generate compressed waveform data. At next step SP30, the compressed waveform data, which have not yet ben transferred to the waveform file, are transferred to the waveform file. After that, the routine moves on to step SP31 where the waveform file is closed, and then the processing flow returns to the main routine. Then, the user is allowed to listen to a generated tone waveform, by reproducing the thus-generated waveform file after decompression. In case the abort button 88 is activated, the waveform data remaining in the transfer buffer area are discarded at step SP29 above, and then the waveform file is discarded at step SP31 above.

2.10. Details of Compression Process:

The following paragraph describe the details of the compression process subroutine invoked at step SP33 above, with reference to FIG. 16. At first step SP81 of the compression process subroutine, a sub-band filtering process is performed on the waveform data for analysis of sub-bands contained therein, so as to provide samples of each individual sub-band frequency.

At next step SP82, the waveform data are subjected to a fast Fourier transform process for a frequency analysis of the waveform data. Then, at step SP83, an acoustic psychological model for a masking effect is computed on the basis of the results of the frequency analysis, and allowable noise levels in the individual sub-bands are evaluated. Then, the numbers of bits to be allotted to the individual sub-bands are determined, on the basis of respective output signal levels of the sub-bands as well as the evaluated allowable noise levels.

After that, the compression process subroutine moves on to step SP84, where, for each of the sub-bands, some of the frequency sample bits are deleted on the basis of the allotted number of bits and thereby the waveform data are compressed. The thus-compressed waveform data are stored into a predetermined area of the RAM 23. Note that if any previously-compressed waveform data are present in that predetermined area, the newly-compressed waveform data are stored in addition to the previously-compressed waveform data.

3. Advantageous Results Achievable by the Embodiment

According to the described embodiment of the present invention, waveform data are generated by the frame cycle event process routine (FIG. 10) on condition that a frame cycle message is generated. Namely, whenever a frame cycle message is generated, the tone generator processing is carried out at step SP43 of FIG. 10, irrespective of whether or not the process for generating waveform data for the preceding frame has been completed. However, when waveform data are generated by the waveform data storage routine, it is absolutely necessary that the process for generating waveform data for the preceding frame have been completed; more specifically, the generator processing for the preceding frame must have been completed before the tone generator processing is carried out for the current frame at step SP27 of FIG. 9.

Thus, according to the described embodiment, the condition or criteria for starting the waveform data generation can be set appropriately depending on an intended application of waveform data (i.e., depending on whether waveform data are to be reproduced in real time or to be used to create a waveform file). If waveform data are to be reproduced in real time, then they can be generated at accurate timing, while if waveform data are to be used to create a waveform file, all the necessary modules can be activated. Thus, the described embodiment can provide a tone waveform with high accuracy.

Figure 12A:
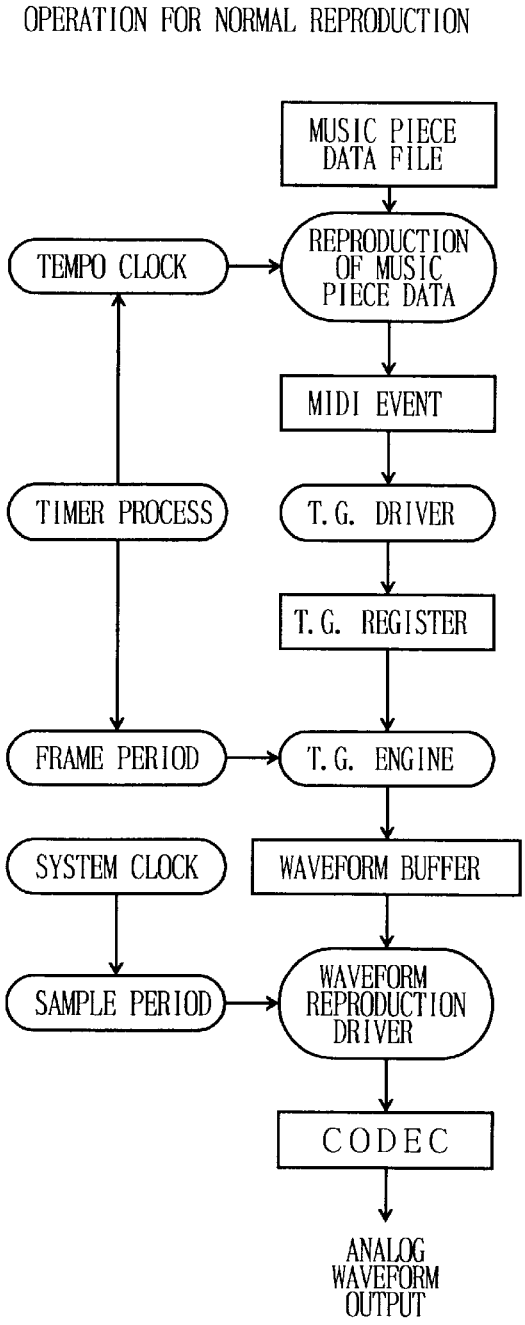
FIG. 12 is a flow chart explanatory of essential operation of the embodiment of the present invention.
Figure 12B:
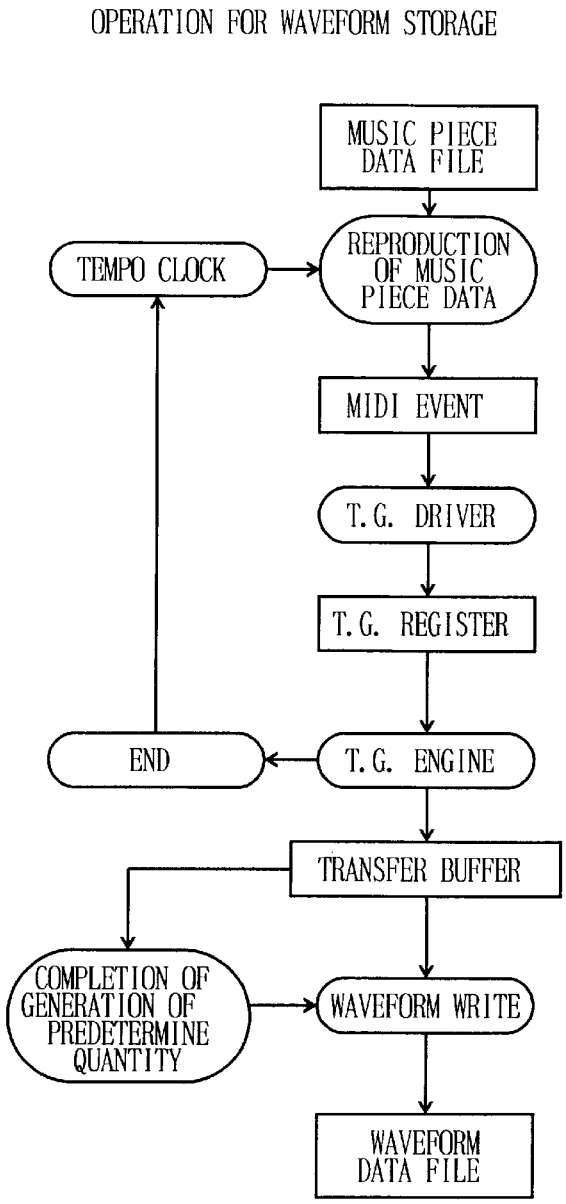

Flow chart of FIG. 12A summarizes operation of the embodiment in real-time reproduction. As shown, the reproduction of music piece data and the generation of waveform data depend on the timer messages responsive to the "tempo clock cycle" and "frame cycle" that are generated by the operating system on the basis of the outputs from the timer 24. Further, flow chart of FIG. 12B summarizes operation of the embodiment in storing waveform data into a waveform file. As shown, timing to reproduce the music piece data and generate the waveform data is set as desired in accordance with a length of time required for the waveform data generation process in the preceding frame.

Further, in the described embodiment, the condition for starting the waveform generation can be changed halfway through the real-time reproduction. Thus, the user is allowed to record the waveform data of only a desired portion of the music piece, by clicking on the reproduction start button 62 via the mouse to start reproducing the music piece at its very beginning and then clicking on the waveform data recording button 71 upon arrival at the desired portion

4. Modifications

The present invention should never construed as being limited to the above-described embodiment and may be modified variously as exemplified below.

First, according to the present invention, only one tone generator module and only one effect module may be employed both in the real-time reproduction and in the waveform file creation. However, in the case of the real-time reproduction, there would occur various inconveniences unless the waveform data calculation is completed within a predetermined frame cycle; thus, if the real-time reproduction is performed by a CPU of low capability, then it is more preferable to use a substitute module that can significantly reduce the loads on the CPU.

Here, each tone generator module or effect module which is designated in a music piece file to be reproduced is called a "regular module", while each tone generator module or effect module which can be used in place of such a regular module is called a "substitute module". Note that each of the regular modules can be modified by the user editing the corresponding music piece file.

It is desirable that such a substitute module be previously allotted the same program number and bank number as the regular module and an automatic switch be made between the substitute module and the regular module. For instance, the CPU may be designed to detect its own arithmetic processing capability for comparison to loads of the individual modules and automatically determine which of the regular and substitute modules should be used for the real-time reproduction. Alternatively, for each of the regular modules, the user may designate a particular substitute module to be used for the real-time reproduction.

Figure 13:
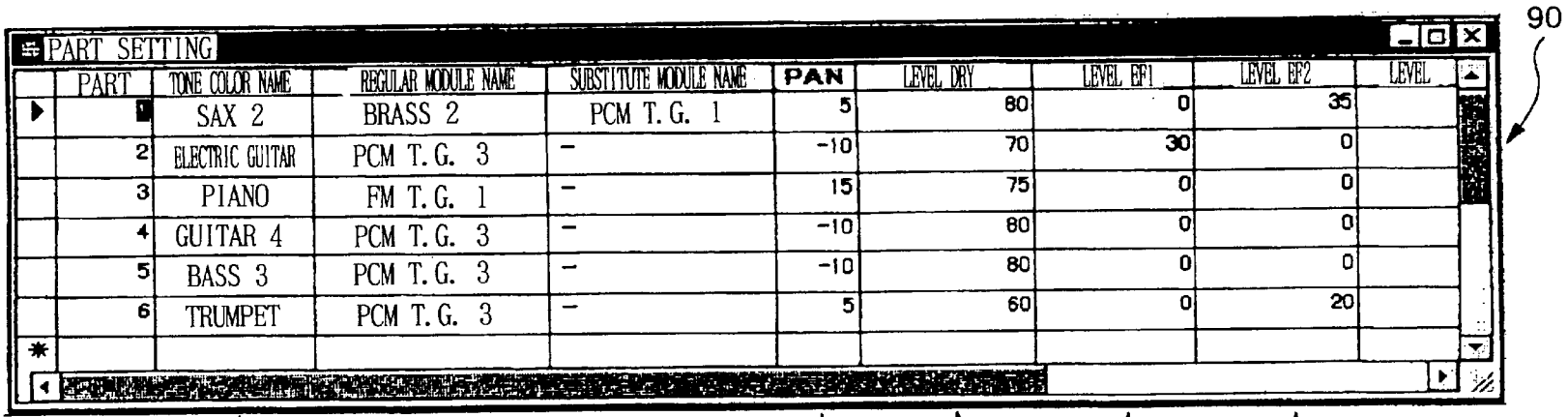
FIG. 13 is a diagram showing a part setting window in a modification of the present invention.

In the latter case, a part setting window 90 may be shown on the display 28, as illustrated in FIG. 13, in response to a predetermined user operation. In FIG. 13, reference numeral 91 represents a part number display box, where part numbers from "1" to "16" are displayed consecutively in a top-to-bottom direction. Reference numeral 92 represents a tone color name display box, where are displayed tone color names allocated to the individual parts. Further, reference numeral 91 represents a regular module name display box, where are displayed names of regular modules (for use in the waveform file generation) allocated to the individual parts.

Furthermore, reference numeral 94 represents a substitute module name display box, where are displayed names of substitute modules to be used for a real-time performance in place of the regular modules. Note that the mark "-" within each small rectangular box indicates that the regular module can be used as it is. Therefore, for "Sax 2" tone color of part 1 in the illustrated example, "Brass 2" (physical model tone generator) is used in the waveform file generation and "PCM Tone Generator 1" is used in the real-time performance.

The part setting window 90 includes various other boxes to be used for setting various levels. More specifically, these other boxes are provided for setting send levels of data to be transmitted from the tone generator modules to the buffers WB1–WB7, the details of which are discussed in Japanese Patent Application No. HEI-10-133761. The user is allowed to change these settings by putting the cursor on a desired box in one of the areas, so that a desired substitute module can be allocated to any one of the regular modules.

Whereas, in the illustrated example, "PCM tone generator 1" is allocated as a substitute module for "Brass 2" (physical mode tone generator), various other allocation is also possible. For instance, a four-operator or two-operator FM tone generator may be allocated as a substitute module for a six-operator FM tone generator, or an FM tone generator of a 24 kHz sampling frequency equipped with no tone color filter may be allocated as a substitute module for an FM tone generator of 48 kHz sampling frequency equipped with a tone color filter.

Further, for each of the tone generator modules, there may be stored substitution information indicating which of other tone generator modules can substitute for that tone generator module so that a specific substitute module can be selected automatically or manually on the basis of the substitute information. Moreover, arrangements may be made to allow the user to edit such substitution information.

Furthermore, whereas the preferred embodiment has been described above based on the premise that all the programs of the tone synthesis system are installed previously in a personal computer, these programs may be stored in a storage medium, such as a CD-ROM and floppy disk, and distributed in the storage medium.

In summary, the present invention is characterized by being able to change the condition for starting waveform data generation for every section of a music piece, and thus it can generate a tone waveform in optimal condition corresponding to its processing capability.

What is claimed is:

1. A method of generating waveform data on the basis of performance information, said method comprising:

a waveform data generation step of generating waveform data for fixed or variable sections on the basis of performance information;

a step of receiving a first or second command;

a step of validating performance information in real time, when the first command is received;

a step of, when said first command is received, issuing an instruction to said waveform data generation step for performing real-time generation of waveform data for each of the sections on the basis of the performance information validated in real time, in accordance with a generation start condition that predetermined timing has arrived;

a step of, when said first command is received, reproducing the waveform data for each of the sections generated in real time by said waveform data generation step in response to said instruction;

a step of, when said second command is received, issuing an instruction for performing non-real-time generation of waveform data for each of the sections, in accordance with a generation start condition that processing by said waveform data generation step has already been completed for a preceding section;

a step of, when said second command is received, validating, in non-real time, performance information corresponding to each of the sections for which the non-real-time generation of waveform data is instructed; and a step of, when said second command is received, storing, into memory, waveform data generated by said waveform data generation step on the basis of the performance information validated in non-real time.

2. An apparatus for generating waveform data on the basis of performance information, said apparatus comprising:

a supply device adapted to supply performance information;

an input device adapted to receive a first or second command;

a memory adapted to store waveform data; and a processor coupled with said supply device and said memory, said processor being adapted to:

perform waveform data generation processing for generating waveform data for fixed or variable sections on the basis of the performance information supplied by said supply device, in response to a waveform generation instruction;

receive said first or second command via said input device;

in response to receipt of said first command, receive the performance information from said supply device so as to reproduce the performance information in real time;

in response to receipt of said first command, issue the waveform generation instruction to said waveform data generation processing to generate waveform data based on the performance information reproduced in real time, on condition that predetermined timing has arrived;

in response to receipt of said second command, designate a next section for which waveform data is to be generated in non-real time and issue the waveform generation instruction to said waveform data generation processing, on condition that said waveform data generation processing has already been completed for a preceding section;

in response to receipt of said second command, receive the performance information from said supply device so as to reproduce, in non-real time, the performance information corresponding to the designated next section; and in response to receipt of said second command, store, into memory, waveform data generated by said waveform data generation processing on the basis of the performance information reproduced in non-real time; and an output device coupled to said processor and adapted to reproductively output, in real time, the waveform data generated by said waveform data generation processing on the basis of the performance information reproduced in non-real time.

3. A machine-readable storage medium containing a group of instructions to cause said machine to implement a method of generating waveform data on the basis of performance information, said method comprising:

a waveform data generation step of generating waveform data for fixed or variable sections on the basis of supplied performance information, in response to a waveform generation instruction;

a step of receiving a first or second command;

a step of validating the performance information in real time, when said first command is received;

a step of, when said first command is received, issuing the waveform generation instruction to said waveform data generation step to generate waveform data based on the performance information validated in real time by execution of said waveform data generation step in accordance with the issued waveform generation instruction, in accordance with a generation start condition that predetermined timing has arrived;

a step of, when said first command is received, reproductively outputting the waveform data for each of the sections generated by execution of said waveform data generation step;

a step of, when said second command is received, designating a next section for which waveform data is to be generated in non-real time and issuing the waveform generation instruction to said waveform data generation step, in accordance with a generation start condition that processing by said waveform data generation step has already been completed for a preceding section;

a step of, when said second command is received, validating, in non-real time, the performance information corresponding to the designated next section; and a step of, when said second command is received, storing, into memory, waveform data generated by execution of said waveform data generation step on the basis of the performance information validated in non-real time.

4. A method of generating waveform data for each of fixed or variable sections on the basis of performance information, said method comprising:

a plurality of waveform data generation steps of generating waveform data using respective ones of different generation schemes based on performance information;

a step of receiving a first or second command;

a step of selecting one of said plurality of waveform data generation steps, depending on which one of the first and second commands is received;

a step of, when said first command is received, instructing the selected waveform data generation step to generate waveform data for each of the sections, in accordance with a generation start condition that predetermined timing has arrived; and a step of, when said second command is received, instructing said selected waveform data generation step to generate waveform data for each of the sections, in accordance with a generation start condition that processing by said waveform data generation step has already been completed for a preceding section.

5. An apparatus for generating waveform data on the basis of performance information, said apparatus comprising:

a supply device adapted to supply performance information;

an input device adapted to receive a first or second command; and a processor coupled with said supply device and said input device, said processor being adapted to:

in response to a waveform generation instruction, perform waveform data generation processing, selected from among a plurality of waveform data generation processing using respective ones of different waveform generation schemes, to generate waveform data for fixed or variable sections on the basis of the performance information supplied by said supply device;

receive the first or second command from said input device;

select one of said plurality of waveform data generation processing, depending on which one of the first and second commands is received;

when said first command is received, issue the waveform generation instruction to the selected waveform data generation processing to generate the waveform data by execution of the selected waveform data generation processing responsive to the waveform generation instruction, on condition that predetermined timing has arrived; and when said second command is received, issue the waveform generation instruction to the selected waveform data generation processing to generate the waveform data by execution of the selected waveform data generation processing responsive to the waveform generation instruction, on condition that waveform generation has already been completed for a preceding section.

6. A machine-readable storage medium containing a group of instructions to cause said machine to implement a method of generating waveform data on the basis of performance information, said method comprising:

a step of, in response to a waveform generation instruction, performing waveform data generation processing, selected from among a plurality of waveform data generation processing using respective ones of different waveform generation schemes, to generate waveform data for fixed or variable sections on the basis of supplied performance information;

a step of receiving a first or second command;

a step of selecting one of said plurality of waveform data generation processing, depending on which one of the first and second commands is received;

a step of, when said first command is received, issuing the waveform generation instruction to the selected waveform data generation processing to generate the waveform data by execution of the selected waveform data generation processing responsive to the waveform generation instruction, on condition that predetermined timing has arrived; and a step of, when said second command is received, issuing the waveform generation instruction to the selected waveform data generation processing to generate the waveform data by execution of the selected waveform data generation processing responsive to the waveform generation instruction, based on condition that waveform generation has already been completed for a preceding section.

7. A method of generating waveform data on the basis of performance information and storing the generated waveform data, said method comprising:

a step of generating waveform data in real time on the basis of performance information and simultaneously reproducing the generated waveform data;

a step of stopping reproduction of the waveform data halfway through the reproduction and specifying a stop position in the performance information;

a step of generating, in non-real time, the waveform data corresponding to the performance information for a portion following the stop position; and a step of storing, into memory, the waveform data reproduced in non-real time.

8. An apparatus for generating waveform data on the basis of performance information and storing the generated waveform data, said apparatus comprising:

an input device adapted to receive an reproduction instruction and a stop instruction;

a memory adapted to store waveform data; and a processor coupled with said input device and said memory, said processor being adapted to:

when the reproduction instruction is received via said input device, generate waveform data in real time on the basis of supplied performance information and reproduce the generated waveform data;

when the stop instruction is received via said input device, stop real-time generation of the waveform data halfway through the generation and generate, in non-real time, the waveform data corresponding to the performance information for a portion following a stop position where the real-time generation of the waveform data has been stopped; and store, into memory, the waveform date reproduced in non-real time.

9. A machine-readable storage medium containing a group of instructions to cause said machine to implement a method of generating waveform data on the basis of performance information, said method comprising:

a step of generating waveform data in real time on the basis of performance information and simultaneously reproducing the generated waveform data;

a step of stopping reproduction of the waveform data and specifying a stop position in the performance information;

a step of generating, in non-real time, the waveform data corresponding to the performance information for a portion following the stop position; and a step of storing, into memory, the waveform data reproduced in non-real time.

10. A method of generating waveform data on the basis of performance information and storing the generated waveform data, said method comprising:

a step of generating waveform data in non-real time on the basis of the performance information and simultaneously storing the generated waveform data into memory;

a step of displaying information indicative of a position in the waveform data corresponding to the performance information where non-real time generation is being performed;

a step of receiving a stop instruction halfway through the non-real time generation; and a step of stopping the non-real time generation and storage of the waveform data, when the stop instruction is received.

11. An apparatus for generating waveform data on the basis of performance information and storing the generated waveform data, said apparatus comprising:

an input device adapted to receive a storage instruction and a stop instruction;

a memory adapted to store waveform data; and a processor coupled with said input device and said memory, said processor being adapted to:

generate waveform data in non-real time on the basis of supplied performance and simultaneously store the generated waveform data into memory, when the storage instruction is received via said input device;

stop the non-real time generation and storage of the waveform data, when the stop instruction is received.

12. An apparatus as claimed in claim 11 which further comprises a display coupled to said processor and wherein said processor is adapted to display, on said display, information indicative of a position in the waveform data corresponding to the performance information where the non-real time generation is being performed.

13. A machine-readable storage medium containing a group of instructions to cause said machine to implement a method of generating waveform data on the basis of performance information and storing the generated waveform data, said method comprising:

a step of generating waveform data in non-real time on the basis of the performance information and storing the generated waveform data into memory;

a step of receiving a stop instruction halfway through the non-real time generation; and a step of stopping the non-real time generation and storage of the waveform data, when the stop instruction is received.

14. A machine-readable storage medium as claimed in claim 13 which further comprises a step of displaying information indicative of a position in the waveform data corresponding to the performance information where the non-real time generation is being performed.

15. A method of generating waveform data on the basis of performance information, said method comprising:

a step of designating one of a first mode and a second mode;

a step of generating performance information in accordance with real time of a reproductive performance, when said first mode is designated;

a step of issuing a waveform generation instruction on condition that predetermined timing has arrived, when said first mode is designated;

a step of generating waveform data for fixed or variable sections on the basis of the performance information generated in real time, in response to the waveform generation instruction issued when said first mode is designated;

a step of generating performance information in non-real time, when said second mode is designated;

a step of, when said second mode is designated, generating, in non-real time, waveform data for fixed or variable sections on the basis of the performance information generated in non-real time, wherein waveform data for a current time section is generated on condition that generation of waveform data for a preceding time section has already been completed; and a step of storing, into memory, the waveform data generated in non-real time on the basis of the performance information generated in non-real time.

16. An apparatus for generating waveform data on the basis of performance information, said apparatus comprising:

a supply device adapted to supply performance information;

a designation device adapted to designate a first mode or a second mode;

a memory adapted to store waveform data;

a processor coupled with said supply device, said designation device and said memory, said processor being adapted to:

control said supply device to cause the performance information to be generated thereby in accordance with real time of a reproductive performance, when said first mode is designated by said designation device;

issue a waveform generation instruction on condition that predetermined timing has arrived, when said first mode is designated;

generate waveform data for fixed or variable sections on the basis of the performance information generated in real time, in response to the waveform generation instruction issued when said first mode is designated;

control said supply device to cause the performance information to be generated thereby in non-real time, when said second mode is designated;

when said second mode is designated, generate waveform data for fixed or variable sections in non real time on the basis of the performance information generated in non-real time, wherein waveform data for a current time section is generated on condition that generation of waveform data for a preceding time section has already been completed;

store, into memory, the waveform data generated in non-real time on the basis of the performance information generated in non-real time; and an output device coupled to said processor and adapted to reproductively output, in real time, the waveform data generated on the basis of the performance information generated in accordance with real time in said first mode.

17. A machine-readable storage medium containing a group of instructions to cause said machine to implement a method of generating waveform data on the basis of performance information, said method comprising:

a step of designating one of a first mode and a second mode;

a step of generating performance information in accordance with real time of a reproductive performance, when said first mode is designated;

a step of issuing a waveform generation instruction on condition that predetermined timing has arrived, when said first mode is designated;

a step of generating waveform data for fixed or variable sections on the basis of the performance information generated in real time, in response to the waveform generation instruction issued when said first mode is designated;

a step of generating performance information in non-real time, when said second mode is designated;

a step of, when said second mode is designated, generating waveform data for fixed or variable sections on the basis of the performance information generated in non-real time, wherein waveform data for a current time section is generated on condition that generation of waveform data for a preceding time section has already been completed; and a step of storing, into memory, the waveform data generated in non-real time on the basis of the performance information generated in non-real time.

* * * * *